US006845223B2

(12) United States Patent
Eun et al.

(10) Patent No.: US 6,845,223 B2
(45) Date of Patent: Jan. 18, 2005

(54) IMAGE FORMING APPARATUS TO FORM UNIFORM NIP

(75) Inventors: Jong-moon Eun, Suwon (KR); Hyun-wook Bae, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/298,599

(22) Filed: Nov. 19, 2002

(65) Prior Publication Data

US 2003/0143002 A1 Jul. 31, 2003

(30) Foreign Application Priority Data

Jan. 30, 2002 (KR) ..... 2002-5321

(51) Int. Cl.[7] ..... G03G 15/20
(52) U.S. Cl. ..... 399/310
(58) Field of Search ..... 399/66, 121, 310, 399/313, 314, 315, 316, 317, 318

(56) References Cited

U.S. PATENT DOCUMENTS 5,697,033 A * 12/1997 Ichikawa et al. ..... 399/310

FOREIGN PATENT DOCUMENTS

JP 07210007 A * 8/1995 ..... G03G/15/16

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

An image forming apparatus having a uniform nip between a photosensitive body and a transfer body. The image forming apparatus has a photosensitive unit on which an electrostatic latent image is formed, a developer feed unit to feed a developer onto the electrostatic latent image to form a visible image, and a transfer unit. The transfer unit has a curved side of a semi-hollow tubular shape that contacts the photosensitive unit, and a planar side opposite the curved side and secured at a support member, to transfer the visible image formed on the photosensitive unit to a recording medium. The curved side of the transfer unit has a uniform radius of curvature in an axial direction. Accordingly, the image forming apparatus can not only maintain a constant nip in relation to electrical resistance and contact pressure, but can also adjust the electrical resistance of the transfer unit by appropriately setting factors such as volume resistivity of the conductive elastic member.

11 Claims, 6 Drawing Sheets

IMAGE FORMING APPARATUS TO FORM UNIFORM NIP

CROSS-REFERENCE TO RELATED APPLICATIONS

This application claims the benefit of Korean Application No. 2002-5321, filed Jan. 30, 2002, in the Korean Intellectual Property Office, the disclosure of which is incorporated herein by reference.

BACKGROUND OF THE INVENTION

1. Field of the Invention

The present invention relates to an image forming apparatus employing a contact electrophotographic developing method, and more particularly, to an image forming apparatus that forms a uniform nip between a photosensitive member and a transfer device.

2. Description of the Related Art

An electrophotographic developing method is used in a wide range of image forming apparatuses such as copiers, laser printers, LED print head printers, facsimile machines, etc. The stages of the electrophotographic developing method include electric charging, light exposure, development and fixing.

FIG. 1 is a view showing an image forming process according to a conventional electrophotographic processor. Referring to FIG. 1, an electric-charge roller 44 electrically charges the surface of a photosensitive drum 40 with a uniform charge. After being electrically charged, the surface of the photosensitive drum 40 receives electric signals to form an image from an exposure unit (not shown), which exposes the photosensitive drum to light. Accordingly, an electrostatic latent image is formed on the photosensitive drum 40. The electrostatic latent image is developed by toner that is fed from a developer unit 48, and accordingly, turned to a visible image.

Meanwhile, a recording medium 52 stacked in a recording medium feed cassette 50 is picked up by a pickup roller 54, and conveyed between the photosensitive drum 40 and a transfer roller 56 by the rotation of conveyance rollers 55.

Next, by the electrophotographic interaction between the photosensitive drum 40 and the transfer roller 56, the visible image on the photosensitive drum 40 is transferred onto the surface of the recording medium 52. More specifically, due to the negative electric charge of the toner transferred onto the photosensitive drum 40, when positive electric charge is applied to the transfer roller 56, which is in contact with the photosensitive drum 40 with the recording medium 52 being placed therebetween, the toner image on the surface of the negative photosensitive drum 40 is transferred onto the recording medium 52 of the positive electric charge.

The quality of the image transferred onto the recording medium 52 depends on the voltage transferred onto the transfer roller 56, and a uniformity of a nip between the photosensitive drum 40 and the transfer roller 56 in contact with each other. Here, the 'nip' is substantially a line formed in a lengthwise direction when the photosensitive drum 40 and the transfer roller 56 contact each other.

After the image is formed on the recording medium 52, the recording medium 52 is passed between a heating roller 10 and a pressing roller 30 to fix the image to the recording medium 52 by a high degree of heat from the heating roller 10 and pressure from the pressing roller 30. After the image is fixed, the recording medium 52 is discharged outside the printer body by the rotation of an upper discharge roller 38 and a lower discharge roller 36, and then piled on a document tray 58 disposed outside of the body. After the toner transfer, there remains residual toner and an electrostatic latent image on the surface of the photosensitive drum 40, which are eliminated by a cleaner 42 and an electric-charge elimination lamp (not shown).

FIG. 2 is a side view showing the conventional transfer roller 56. Referring to FIG. 2, the transfer roller 56 has a cylindrical conductive rubber portion 57 having a length L, and a center shaft 60 serving as a center of rotation of the cylindrical conductive rubber portion 57. The cylindrical conductive rubber portion 57 is formed such that the diameters a1, a2 and a3 in an axial direction are identical to each other. At opposing ends of the cylindrical conductive rubber portion 57, springs 61 are disposed. One end of each spring 61 is supported on a frame 62 of the printer body. Accordingly, by a predetermined pressure of the springs 61 in an upward direction (i.e., toward the photosensitive drum 40), a nip is formed between the transfer roller 56 and the photosensitive drum 40.

FIG. 3 is a front view showing the transfer roller 56 and the photosensitive drum 40 in contact with each other, and forming the nip therebetween. Referring to FIG. 3, the transfer roller 56 is disposed under the photosensitive drum 40, and the nip is formed when the cylindrical conductive rubber portion 57 of the transfer roller 56 contacts the outer circumference of the photosensitive drum 40.

Here, the transfer roller 56 has the same stress distribution as a beam with the opposing ends being supported. Accordingly, due to a varying moment value, an intermediate portion of the conductive rubber droops. Since the reaction force at both ends of the transfer roller 56 is the same, the maximum value of the droop (t) can be found at a point distanced from one end of the cylindrical conductive rubber portion 57 by a length of L/2.

If the nip is formed between the photosensitive drum 40 and the transfer roller 56 with the droop occurring at the intermediate point of the transfer roller 56, the pressing force of the intermediate point of the cylindrical conductive rubber portion 57 against the photosensitive drum 40 is relatively weaker than the pressing force at both ends of the conductive rubber portion 57. Accordingly, toner transferability from the photosensitive drum 40 to the recording medium 52 at the intermediate point of the cylindrical conductive rubber portion 57 is deteriorated as compared to both ends. As a result, when the recording medium 52 passes through the transfer roller 56 and the photosensitive drum 40, image density at the center of the recording medium 52 is weaker than at the opposing ends.

Furthermore, when placed in a relatively high temperature for a long time, there sometimes occurs a migration of the substances of a low molecular mass inside the transfer roller 56 to the contact area between the transfer roller 56 and the photosensitive drum 40. This causes a horizontal band to appear in the vicinity of the contact area of the photosensitive drum 40. In order to minimize such migration, a special rubber resin must be added while coating or tubbing must be performed on the outer layer of the transfer roller 56. As a result, manufacturing costs increase.

SUMMARY OF THE INVENTION

Accordingly, it is an object of the present invention to provide an image forming apparatus capable of maintaining a uniform nip between a photosensitive body and a transfer device along the entire length of the transfer device, and also capable of preventing the migration phenomenon.

Additional objects and advantages of the invention will be set forth in part in the description which follows and, in part, will be obvious from the description, or may be learned by practice of the invention.

The foregoing and other objects are accomplished by providing an image forming apparatus, including a photosensitive unit on which an electrostatic latent image is formed; a recording medium; a support member; a developer feed unit to feed a developer to the photosensitive unit, thereby forming a visible image from the electrostatic latent image; and a transfer unit including a curved side having a semi hollow tubular shape, to contact the photosensitive unit, and a planar side opposite the curved side, being secured by the support member, to transfer the visible image formed on the photosensitive unit to the recording medium.

According to an aspect of the present invention, the curved side of the transfer unit has a uniform radius of curvature along a longitudinal direction of the semi-hollow tube. Also, the transfer unit may be formed of a conductive polymer having a volume resistivity ranging from $10^8$ Ωcm to $10^{10}$ Ωcm.

The curved side of the transfer unit may be formed into a single layer of a conductive plate, and transfers the visible image onto the recording medium with electric voltage applied through the support member.

The curved side of the transfer unit may be formed into a plurality of layers of conductive plates having a volume resistivity different from each other. The conductive plate of an upper layer has a volume resistivity greater than $1\times10^9$ Ωcm, and the conductive plate of a lower layer has a volume resistivity no more than $1\times10^6$ Ωcm.

The conductive plate may have a thickness less than 3 mm. The transfer unit may have a maximum height from an upper end of the support member less than 10 mm.

The transfer unit may have a nonconductive elastic member inserted between the conductive plate and the support member, to support a recovering force of the conductive plate. The nonconductive elastic member may be made of polyurethane.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
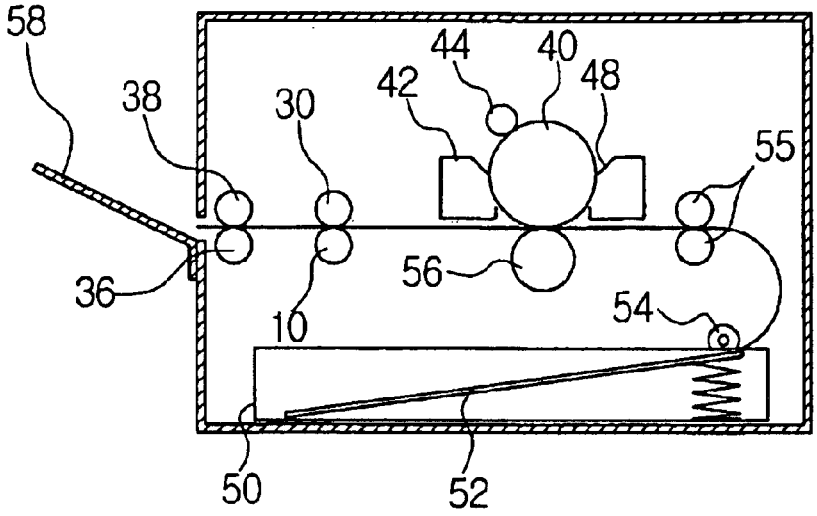
FIG. 1 (PRIOR ART)
FIG. 1 is a view showing a conventional electrophotographic processor.
Figure 2:
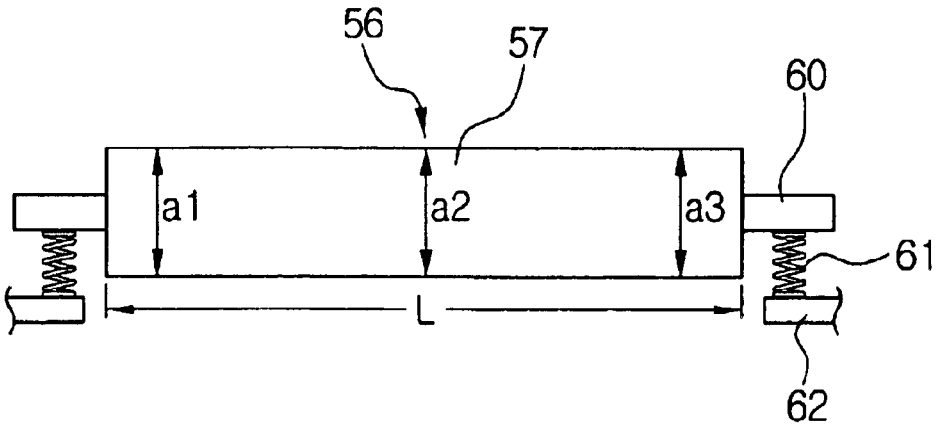
FIG. 2 (PRIOR ART)
FIG. 2 is a side view of the transfer roller of FIG. 1.
Figure 3:
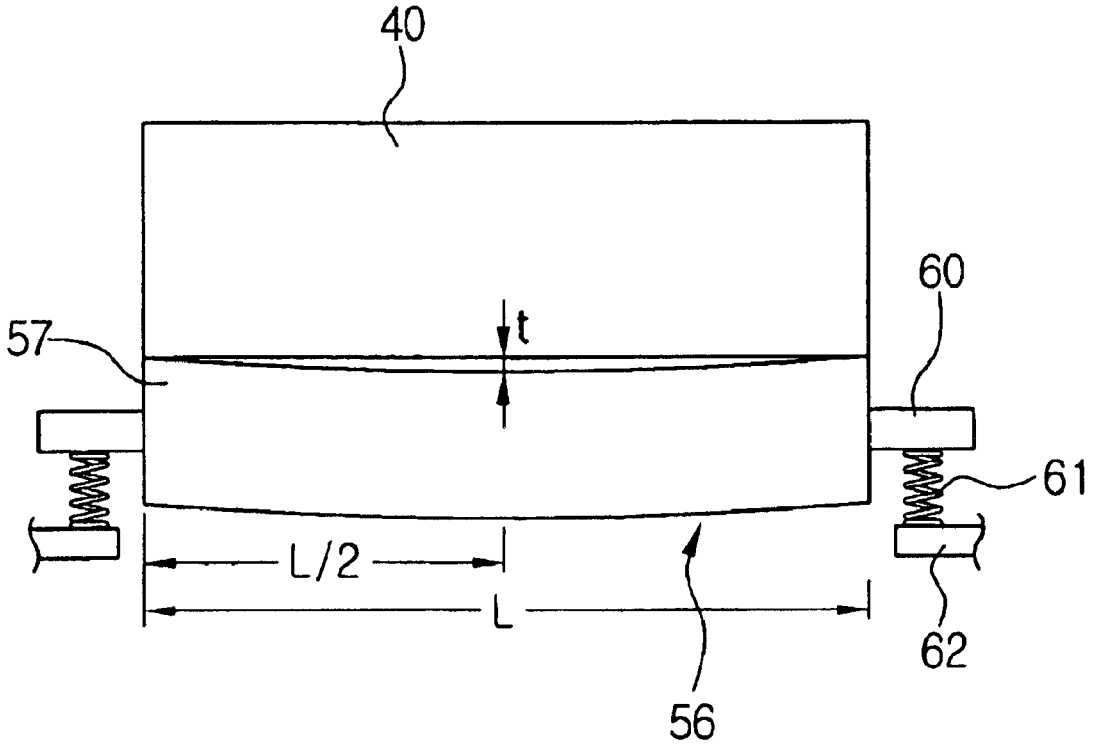
FIG.3 (PRIOR ART)
FIG. 3 is a front view showing the transfer roller of FIG. 2 forming a nip with a photosensitive drum.

Reference will now be made in detail to the present preferred embodiments of the present invention, examples of which are illustrated in the accompanying drawings, wherein like reference numerals refer to like elements throughout.

Figure 4A:
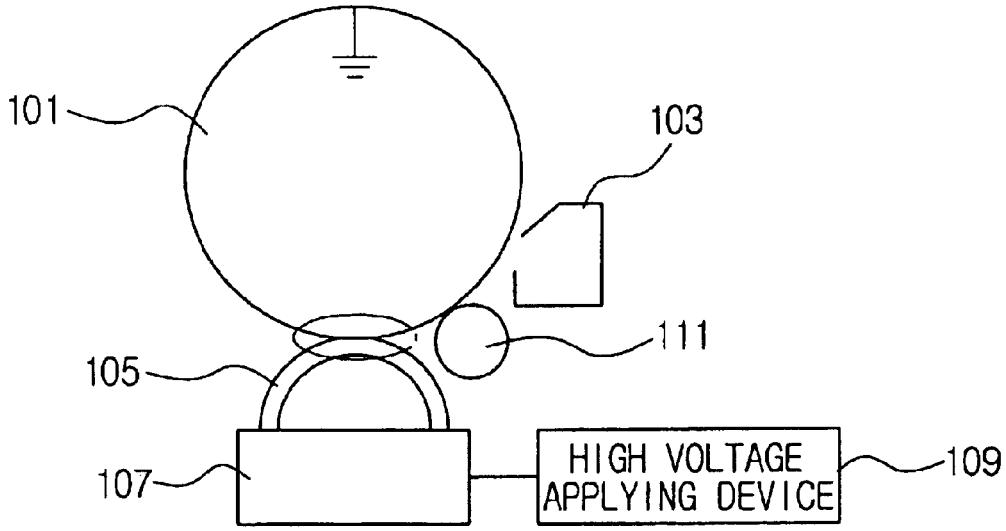
FIG. 4A is a view schematically showing an image forming apparatus according to an embodiment of the present invention.

FIG. 4A is a view schematically showing an image forming apparatus according to an embodiment of the present invention. The image forming apparatus includes a photosensitive unit 101, a developer feed unit 103, a transfer unit 105, a support member 107, a high voltage applying device 109, and a guide unit 111.

The photosensitive unit 101 is uniformly electrically charged by a charge roller (not shown). The electrically charged surface of the photosensitive unit 101 receives an electric signal from a light exposure unit (not shown), i.e., is exposed to light, thereby forming an electrostatic latent image thereon.

The developer feed unit 103 feeds toner to the electrostatic latent image formed on the surface of the photosensitive unit 101, to thereby change the electrostatic image into a visible image.

One end of the transfer unit 105 contacts the photosensitive unit 101, while the other end thereof is secured by the support member 107, thereby transferring the visible image on the photosensitive unit 101 onto a recording medium (not shown). Here, the transfer unit 105 is formed in the shape of a semi-hollow tube. One end of the semi-hollow tube of the transfer unit 105 contacts the photosensitive unit 101 and is curved. Another end of the semi-hollow tube is planar in shape and is secured to the support member 107. The radius of curvature of the curved end of the transfer unit 105 is set so as not to interfere with the rotation of the photosensitive unit 101. The surface of the curved end is abraded such that the nip-forming portion does not interfere with the rotation of the photosensitive unit 101.

The support member 107 is attached to the planar end of the transfer unit 105, to thereby secure the transfer unit 105. A high voltage is applied by the high voltage applying device 109 to the support member 107, and uniformly applied to the transfer unit 105, thereby transferring the visible image on the photosensitive unit 101 to the recording medium. The high voltage applying device 109 may also be integrally formed with the support member 107.

Figure 4B:
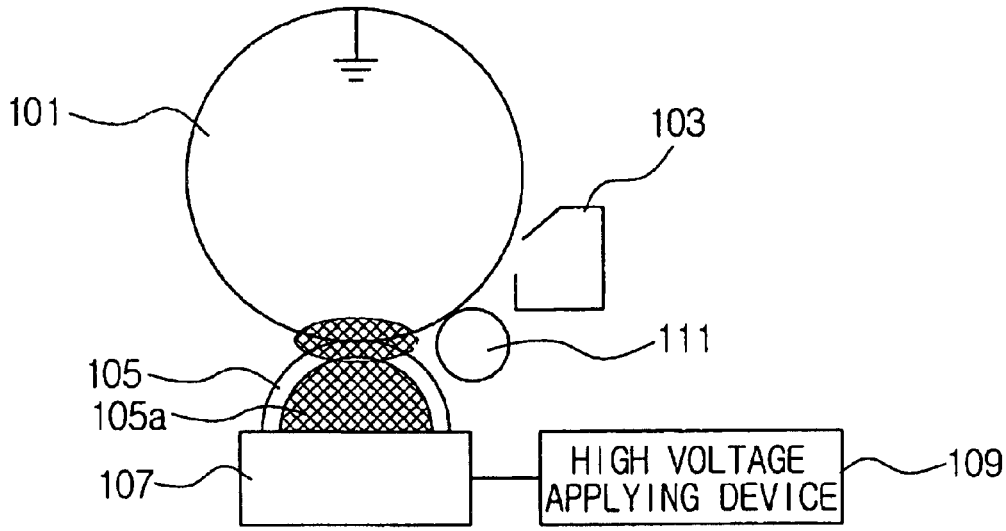
FIG. 4B is a schematic view of FIG. 4A according to another embodiment of the present invention.

In FIG. 4A, the transfer unit 105 is formed of a single layer, namely, a conductive plate. FIG. 4B illustrates another embodiment of the present invention including a second layer, namely, a non-conductive elastic member 105*a*. The elastic member 105*a* is between the transfer unit 105 and the support member 107, to support the recovery force of the conductive plate.

The guide unit 111 guides the recording medium to the transfer area between the photosensitive unit 101 and the transfer unit 105.

By the contact between the photosensitive unit 101 and the transfer unit 105, the visible image formed on the surface of the photosensitive unit 101 is transferred onto the recording medium by the processes as described below.

The photosensitive unit 101 is rotated at a predetermined speed, and contacts the transfer unit 105. The recording medium is inserted into the contact area between the photosensitive unit 101 and the transfer unit 105. By the contact of the photosensitive unit 101 and the transfer unit 105, a predetermined contact area, i.e., a nip is formed, and the visible image formed by the high voltage applied to the transfer unit 105 is transferred onto the recording medium inserted into the nip area.

Figure 5A:
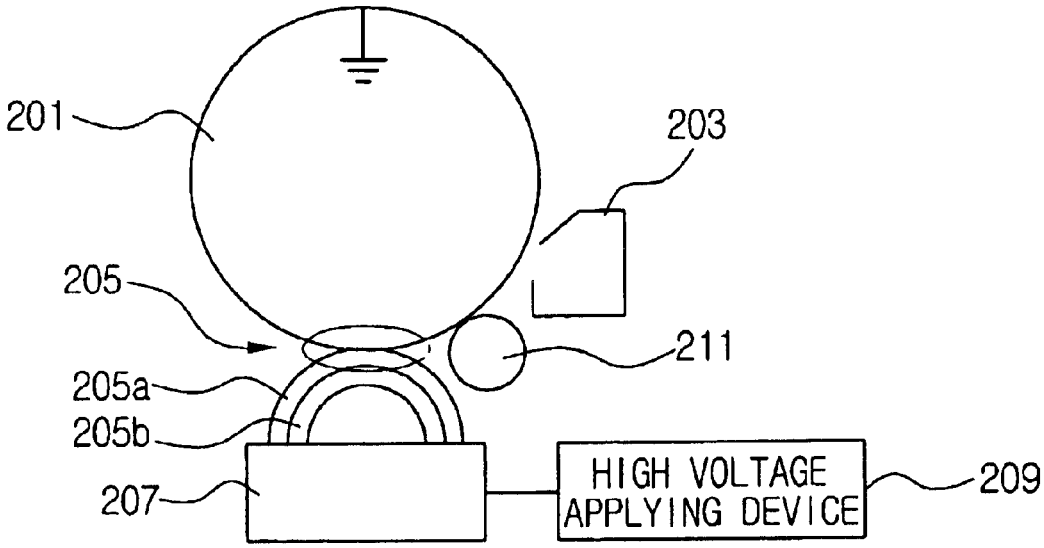
FIG. 5A is a view schematically showing the image forming apparatus according to an embodiment of the present invention, having plural layers of the conductive elastic members.

FIG. 5A is a view schematically showing another embodiment of the present invention.

The image forming apparatus of FIG. 5A includes a photosensitive unit 201, a developer feed unit 203, a transfer unit 205, a support member 207, a high voltage applying device 209, and a guide unit 211. The construction and operation of the photosensitive unit 201, the developer feed unit 203, the support member 207, the high voltage applying device 209, and the guide unit 211 are identical with the construction and operation described above, and therefore, description thereof will be omitted below.

One end of the transfer unit 205 contacts the photosensitive unit 201, while the other end thereof is secured to the support member 207. Here, the shape of the transfer unit 205 is identical to that of the transfer unit 105. The transfer unit 205 has a plurality of conductive layers formed of different conductive plates having different volume resistivities. According to another embodiment, shown in FIG. 5B, a non-conductive elastic member 205*c* can be inserted between a lower layer 205*b* of the transfer unit 205 and the support member 207, to support the conductive plate.

Figure 5B:
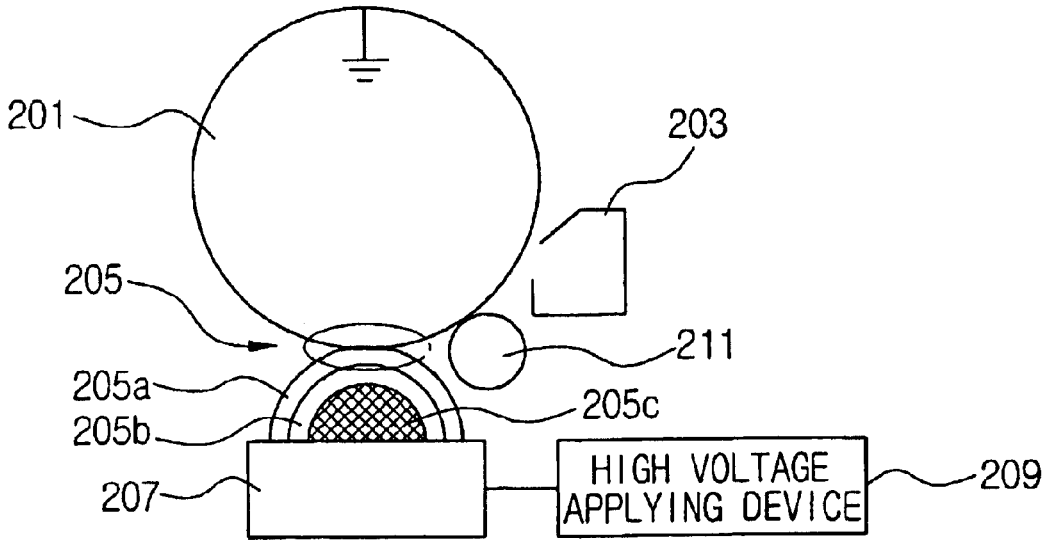
FIG. 5B is a schematic view of FIG. 5A according to another embodiment of the present invention.

In the embodiments of FIGS. 5A and 5B, an upper layer 205*a* of the transfer unit 205 is made of a conductive plate of a high resistivity, while the lower layer 205*b* is made of a conductive plate of high conductivity. Accordingly, even when there are two conductive plates, the variation of the contact pressure and the nip is restricted to a minimum degree, so that the adjustment of electrical resistance can be easily made by the transfer unit 205.

Figure 6:
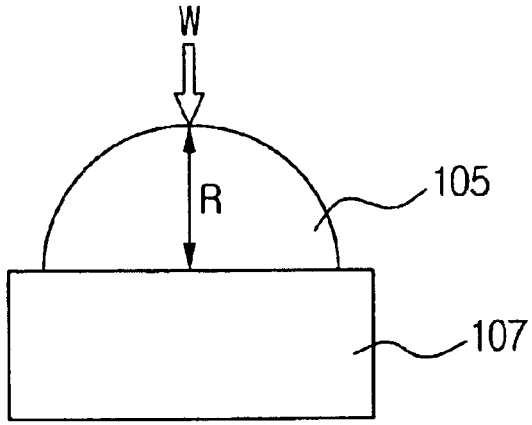
FIG. 6 is a view showing a method for calculating a deformation of the transfer unit and a linear pressure according to an embodiment of the present invention.

FIG. 6 is a view showing a method of calculating a deformation and linear pressure of the transfer unit 105. Referring to FIG. 6, when the transfer unit 105 is in the form of a semi-cylinder having a radius R, a weight W and an "inertial moment" I, a variation of the nip caused by the contact pressure of the photosensitive unit 101 and the transfer unit 105 can be calculated with reference to Castigliano's Theorem by the following:

$$\text{Variation } \delta = W \times R^3/(E \times I) * (3\pi/8 + 3/2\pi - 1) \qquad \text{Equation 1}$$

since the weight W is obtained by, $$W = \delta EI/R^3 * 1/(3\pi/8 + 3/2\pi - 1),$$

the linear pressure F is obtained by:

$$F = W/L = \delta\, EI/LR^3 * 1/(3\pi/8 + 3/2\pi - 1) \qquad \text{Equation 2}$$

$$= \delta\, Et^3/12R^3 * 1/(3\pi/8 + 3/2\pi - 1)$$

where, E is an elastic coefficient (Kgf/cm$^2$) of the conductive elastic member, t is a thickness (cm) of the conductive elastic member, L is a length (cm) of the conductive elastic member, and δ is a variation (cm) of the conductive elastic member.

For example, if a transfer unit 105 having the conductive elastic member of a thickness (t) of 0.2 cm, and an elastic coefficient (E) of 45 Kgf/cm$^2$, is disposed on the photosensitive unit 101 having a variation δ of 0.05 cm, a linear pressure (F=gf/cm) is calculated by the following equation under the condition of R=1 cm:

$$\text{Linear pressure } F = \delta\, Et^3/12R^3 * 1/(3\pi/8 + 3/2\pi - 1)$$

$$= 0.0023 \text{ Kgf/cm} = 2.3 \text{ gf/cm}.$$

Accordingly, the linear pressure by the variation of 2 mm in the center of the semi-hollow tube having a diameter of 10 mm would be 2.3 gf/cm, and the linear pressure can be varied by varying the variation δ, the thickness (t) of the conductive elastic member, and the radius R of the semi-hollow tube. The thickness (t) of the conductive elastic member may be limited below 3 mm, and the radius R of the semi-hollow tube below 10 mm. The linear pressure with respect to the curved portion of the semi-hollow tube may be adjusted between 1 gf/cm and 80 gf/cm. Although a semi-hollow tube having a radius R is illustrated, other shapes are possible. For example, a semi-oval shape may also be used. In such a case, a height from the base to the curved portion of the tube may be below 10 mm.

Furthermore, an elastic supplementary member formed of a foaming agent can be inserted inside the conductive elastic member to supplement the linear pressure F. The foam elastic supplementary member can be made of a non-conductive elastic member such as polyurethane.

Figure 7:
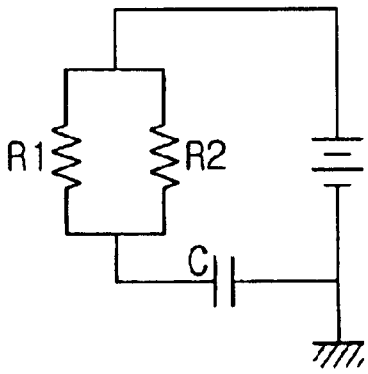
FIG. 7 is a view showing an equivalent circuit in the case of parallel resistance, regardless of the capacitance of the conductive elastic members of FIGS. 4A and 4B.

FIG. 7 is a view showing an equivalent circuit in the case of a parallel resistance, disregarding the capacitance of the conductive elastic member of FIGS. 4A and 4B. Referring to FIG. 7, when the conductive elastic member of the transfer unit 105 is formed in a single layer, the equivalent circuit corresponds to a circuit in which two resistances are connected in parallel with reference to a contact area with the photosensitive unit 101. The capacitance of the elastic member is not in parallel with the resistances.

Let C denote the capacitance of the photosensitive unit 101, R1 is resistance of the left side of the contact area, and R2 is the resistance of the right side of the contact area. The total resistance R of the transfer unit 105 can be obtained by the following:

$$R = \frac{R1 \times R2}{R1 + R2} \qquad \text{Equation 3}$$

Figure 8:
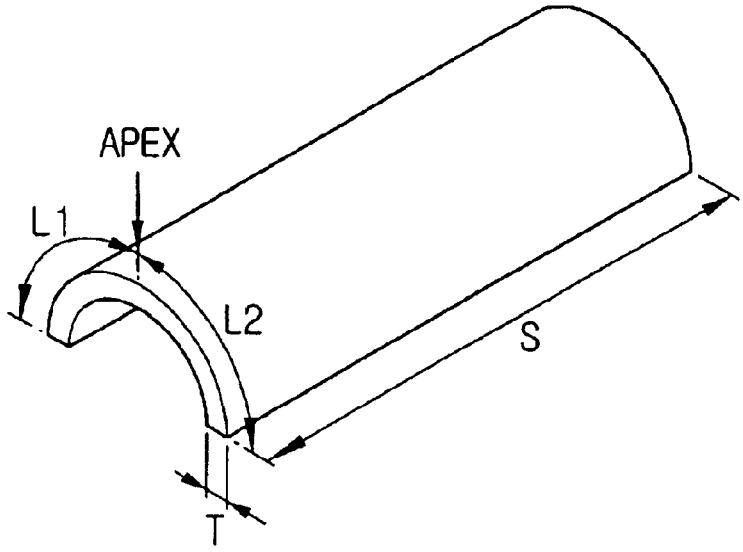
FIG. 8 is a perspective view of the conductive elastic members of FIGS. 4A and 4B.

Meanwhile, referring to FIG. 8, L1 (cm) is the length from a contact point (apex) between the photosensitive unit 101 and the transfer unit 105 to the left end of the curved portion of the transfer unit 105, L2 (cm) is the length from the contact point between the photosensitive unit 101 and the transfer unit 105 to the right end of the curved portion of the transfer unit 105, S(cm) is the width of the conductive elastic member, T(cm) is the thickness of the conductive elastic member, and ρ(Ω cm) is the volume resistivity (specific resistance) of the conductive elastic member. The resistances R1 and R2 are thus obtained by the following equation:

$$R1 = \rho \times \frac{T}{L1 \times S} \qquad \text{Equation 4}$$

-continued $$R2 = \rho \times \frac{T}{L2 \times S}$$

The conductive elastic member may be formed of a conductive polymer having a volume resistivity ranging approximately from $10^9$ Ωcm to $10^{11}$ Ωcm. Also, the conductive elastic member forming the curved portion of the transfer unit 105 has the total resistance R from $1\times10^7$ Ω to $9\times10^9$ Ω. In order to have the total resistance R of $1\times10^7$ Ω to $9\times10^9$ Ω, the volume resistivity ρ, lengths L1 and L2 , width S of the conductive elastic member, and thickness T of the conductive elastic member are adjustable. For example, with the volume resistivity ρ set at $5\times10^9$ Ωcm, the lengths L1 and L2 respectively at 0.5 cm and 1 cm, thickness T of the conductive elastic member at 0.2 cm, and the width S of the conductive elastic member at 23 cm, the resistances R1 and R2 are calculated by:

$$R1=5\times10^9\times0.2/0.5\times23=8.6\times10^7\Omega$$

$$R2=5\times10^9\times0.2/1\times23=4.3\times10^7\Omega$$

With R1 and R2 calculated as above, the total resistance R is obtained from equation 3 by:

$$R=8.6\times10^7\times4.3\times10^7/(8.6+4.3)\times10^7=2.87\times10^7\Omega$$

By appropriately adjusting factors such as volume resistivity, etc., the electrical resistance can be adjusted with little influence to the contact pressure and contact nip when the photosensitive unit 101 and the transfer unit 105 contact each other.

Figure 9:
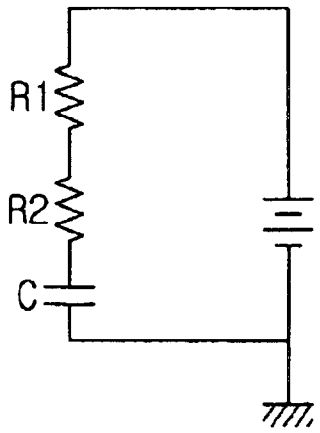
FIG. 9 is a view showing an equivalent circuit in the case in which the resistance at a lower layer is far lower than the resistance at an upper layer, disregarding the capacitance of the conductive elastic members, of FIGS. 5A and 5B.

FIG. 9 is a view showing an equivalent circuit in the case in which the lower layer has a lower resistance than the upper layer, while disregarding the capacitance of the conductive elastic member of FIGS. 5A and 5B.

Referring to FIG. 9, the equivalent circuit corresponds to the circuit in which the resistance of each conductive elastic member is connected in series. In this case, also, the capacitance of the conductive elastic member is not factored in.

With R1 representing the resistance with respect to the conductive plate 205*a* of the upper layer, R2 representing the conductive plate 205*b* of the lower layer, and C representing the capacitance of the photosensitive unit 201, the total resistance R of the transfer unit 205 can be calculated by the following equation:

$$R = R1 + R2 \qquad \text{Equation 5}$$

$$\approx R1(\text{if } R1 > R2)$$

in the case when R1 is substantially greater than R2.

A material of high conductivity may be selected for the conductive plate 205*b* of the lower layer, to avoid undue influence on the total electrical resistance R. The volume resistivity of the conductive plate 205*a* of the upper layer may be set above $1\times10^9$ Ωcm, while the conductive plate 205*b* of the lower layer may be formed of a conductive polymer having a volume resistivity below $1\times10^8$Ωcm. The conductive plate 205*a* of the upper layer may also be formed either of conductive polymer or rubber, so as to maintain elasticity. The conductive plate 205*b* of the lower layer may be formed of a metal sheet. Also, a total thickness of the connected upper and lower plates 205*a* and 205*b* should be below 3 mm.

Meanwhile, if the volume resistivity of the upper conductive plate 205*a* is ρ1 (Ωcm), the volume resistivity of the lower conductive plate 205*b* is ρ2 (Ωcm), the thickness of the upper conductive plate 205*a* is T1 (cm), the thickness of the lower conductive plate 205*b* is T2(cm), and the contact area between the photosensitive unit 201 and the transfer unit 205 is A(cm$^2$), the total resistance R can be calculated by:

$$R=\rho1\times T1/A+\rho2\times T2/A \qquad \text{Equation 6}$$

For example, when the volume resistivity of the upper conductive plate 205*a* is $10^{11}$ Ωcm, the volume resistivity of the lower conductive plate 205*b* is $10^5$Ωcm, the thickness of the upper conductive plate 205*a* is 0.01 cm, the thickness of the lower conductive plate 205*b* is 0.2 cm, and the contact area A between the photosensitive unit 201 and the transfer unit 205 is 2.5 cm$^2$, the total resistance R is, $$R = 10^{11} \times 0.01/2.5 + 10^5 \times 0.2/2.5$$

$$= 0.004 \times 10^{11} + 0.08 \times 10^5$$

$$= 4 \times 10^8 + 8 \times 10^3 = 4 \times 10^8 \Omega.$$

Since the lower conductive plate 205*b* only slightly influences the total resistance, when inserting high conductive materials such as metal sheets, conductive polymer or conductive rubber between the transfer unit 205 and the support member 207, the increase of contact pressure and deterioration of nip formation due to increase of hardiness, can be minimized, and the electrical resistance can be easily adjusted.

The upper and lower conductive plates 205*a* and 205*b* may be bonded to each other with an adhesive. However, other fastening methods such as molding, pressing, or extruding can also be used. It is also possible to coat the lower member with various types of polymers.

Accordingly, the image forming apparatus according to the embodiment of the present invention can maintain the total resistance between $1\times10^7\Omega$ and $9\times10^9\Omega$. Furthermore, by using the relational expression regarding deformation and weight with reference to Castigliano's Theorem, the embodiment of the present invention can maintain a uniform linear pressure and deformation between the photosensitive unit 201 and the transfer unit 205 when the photosensitive unit 201 and the transfer unit 205 contacted each other.

According to the above described embodiments of present invention, the image forming apparatus can adjust the nip in relation to the electrical resistance and the contact pressure, and the conductive elastic member can be made of various types of materials such as a conductive polymer, conductive rubber, etc.

Furthermore, the structure is simpler, and separate parts such as a shaft are not required Accordingly, parts expenses are decreased. Also, since the conductive elastic member can be made of various types of materials such as conductive polymer, conductive rubber, etc., poor conduction caused by a bad surface, which is caused due to the migration or in the abrasion process, can be prevented.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An image forming apparatus to transfer a visible image onto a recording medium, comprising:

a photosensitive unit on which an electrostatic latent image is formed;

a support member;

a developer feed unit to feed a developer to the photosensitive unit, thereby forming the visible image from the electrostatic latent image; and a transfer unit comprising:

a curved side having a semi-hollow tubular shape, to contact the photosensitive unit, and a planar side opposite the curved side, being secured by the support member, the transfer unit to transfer the visible image formed on the photosensitive unit to the recording medium, wherein the curved side of the transfer unit comprises a plurality of layers of conductive plates having different volume resistivities, and the visible image is transferred onto the recording medium with an electric voltage applied through the support member.

2. An image forming apparatus to transfer a visible image onto a recording medium, comprising:

a photosensitive unit on which an electrostatic latent image is formed;

a support member;

a developer feed unit to feed a developer to the photosensitive unit, thereby forming the visible image from the electrostatic latent image; and a transfer unit comprising:

a curved side having a semi-hollow tubular shape, to contact the photosensitive unit, and a planar side opposite the curved side, being secured by the support member, the transfer unit to transfer the visible image formed on the photosensitive unit to the recording medium, wherein the curved side of the transfer unit comprises a single layer of a conductive plate, and the transfer unit is formed of a conductive polymer having a volume resistivity ranging from $10^9$ Ωcm to $10^{11}$ Ωcm.

3. The image forming apparatus of claim 1, wherein the conductive plate of a first one of the layers has a volume resistivity greater than $1\times10^9$ Ωcm, and the conductive plate of a second one of the layers has a volume resistivity no greater than $1\times10^6$ Ωcm.

4. The image forming apparatus of claim 1, wherein the thickness of the conductive plates is less than 3 mm.

5. The image forming apparatus of claim 3, wherein the conductive plate of the first layer is either a conductive polymer or a conductive rubber, and the conductive plate of the second layer is a metal sheet.

6. An image forming apparatus to transfer a visible image onto a recording medium, comprising:

a photosensitive unit on which an electrostatic latent image is formed;

a support member;

a developer feed unit to feed a developer to the photosensitive unit, thereby forming the visible image from the electrostatic latent image; and a transfer unit comprising:

a curved side having a semi-hollow tubular shape, to contact the photosensitive unit, and a planar side opposite the curved side, being secured by the support member, the transfer unit to transfer the visible image formed on the photosensitive unit to the recording medium, wherein the curved side of the transfer unit comprises a single layer of a conductive plate, and the transfer unit further comprises a nonconductive elastic member inserted between the conductive plate and the support member, to support a recovering force of the conductive plate.

7. The image forming apparatus of claim 6, wherein the nonconductive elastic member is made of polyurethane.

8. An image forming apparatus to transfer a visible image onto a recording medium, comprising:

a photosensitive unit on which the visible image is formed from an electrostatic latent image; and a transfer unit to transfer the visible image formed on the photosensitive unit to the recording medium, the transfer unit comprising a side having a semi-hollow tubular shape in contact with the photosensitive unit, wherein the side comprises first and second conductive plates, the first conductive plate having a volume resistivity greater than $1\times10^9$ Ωcm, and the second conductive plate having a volume resistivity no greater than $1\times10^6$ Ωcm.

9. An image forming apparatus to transfer a visible image onto a recording medium, comprising:

a photosensitive unit on which the visible image is formed from an electrostatic latent image;

a transfer unit to transfer the visible image formed on the photosensitive unit to the recording medium, the transfer unit comprising a first side having a semi-hollow tubular shape in contact with the photosensitive unit;

a support member to support the transfer unit, wherein the transfer unit further comprises a second side having a planar shape, opposite the first side and in contact with the support member; and a non-conductive elastic member between the support member and the first side of the transfer unit.

10. An image forming apparatus to transfer a visible image onto a recording medium, comprising:

a photosensitive unit on which the visible image is formed from an electrostatic latent image;

a transfer unit to transfer the visible image formed on the photosensitive unit to the recording medium, the transfer unit comprising a first side having a semi-hollow tubular shape in contact with the photosensitive unit;

a support member to support the transfer unit, wherein the transfer unit further comprises a second side having a planar shape, opposite the first side and in contact with the support member; and a foam agent inserted between the support member and the first side of the transfer unit.

11. An image forming apparatus to transfer a visible image onto a recording medium, comprising:

a photosensitive unit on which the visible image is formed from an electrostatic latent image; and a transfer unit to transfer the visible image formed on the photosensitive unit to the recording medium, the transfer unit comprising a first side having a semi-hollow tubular shape in contact with the photosensitive unit, wherein a linear pressure (F) of the first side of the transfer unit is determined according to:

$$F=\delta E t^3/12R^3*1/((3\pi)/8+3/(2\pi)-1)$$

where, E is an elastic coefficient of the first side of the transfer unit, t is a thickness of the first side of the transfer unit, R is a radius of the transfer unit, and δ is a variation of the first side of the transfer unit.

* * * * *